US007017216B2

(12) United States Patent
Hsieh

(10) Patent No.: US 7,017,216 B2
(45) Date of Patent: Mar. 28, 2006

(54) BLADDER ASSEMBLY AND METHOD OF MANUFACTURING SAME

(76) Inventor: Hsuan-Chi Hsieh, 4F., No.27, Lane 160, Hsin Sheng, S. Rd., Sec. 1, Taipei (TW)

( * ) Notice: Subject to any disclaimer, the term of this patent is extended or adjusted under 35 U.S.C. 154(b) by 0 days.

(21) Appl. No.: 11/084,132

(22) Filed: Mar. 21, 2005

(65) Prior Publication Data

US 2005/0278859 A1 Dec. 22, 2005

Related U.S. Application Data

(63) Continuation-in-part of application No. 10/870,987, filed on Jun. 21, 2004, now abandoned.

(51) Int. Cl.
*A47C 27/08* (2006.01)

(52) U.S. Cl. ..... 5/665; 5/682; 5/687

(58) Field of Classification Search ..... 5/665, 5/682, 687, 644, 654, 655.5
See application file for complete search history.

(56) References Cited

U.S. PATENT DOCUMENTS

| | | | | | |
|---|---|---|---|---|---|
| 3,748,669 | A * | 7/1973 | Warner | 5/682 |
| 3,864,768 | A * | 2/1975 | Fraige et al. | 5/687 |
| 4,079,473 | A * | 3/1978 | Phillips | 5/687 |
| 4,168,555 | A * | 9/1979 | Benjamin | 5/682 |
| 4,247,963 | A * | 2/1981 | Reddi | 5/687 |
| 4,310,936 | A * | 1/1982 | Benjamin | 5/682 |
| 4,479,275 | A * | 10/1984 | Fraige | 5/682 |
| 4,558,476 | A * | 12/1985 | Linder | 5/687 |
| 4,611,357 | A * | 9/1986 | Chelin | 5/671 |
| 4,724,560 | A * | 2/1988 | Christie | 5/644 |
| 4,751,757 | A * | 6/1988 | Moreno | 5/683 |
| 4,901,386 | A * | 2/1990 | Lane | 5/687 |
| 5,001,792 | A * | 3/1991 | Strobel | 5/675 |
| 5,555,580 | A * | 9/1996 | Hsia | 5/665 |
| 5,669,091 | A * | 9/1997 | Chung | 5/687 |
| 5,727,269 | A * | 3/1998 | Chung | 5/680 |
| 5,794,287 | A * | 8/1998 | Chung | 5/687 |
| 5,845,353 | A * | 12/1998 | Chow | 5/685 |
| 6,035,470 | A * | 3/2000 | Chow | 5/687 |
| 6,343,393 | B1 * | 2/2002 | Chow | 5/681 |
| 6,397,415 | B1 * | 6/2002 | Hsieh | 5/644 |
| 6,857,152 | B1 * | 2/2005 | Chow | 5/681 |
| 2005/0166327 | A1 * | 8/2005 | Chow | 5/665 |

* cited by examiner

*Primary Examiner*—Robert G. Santos
(74) *Attorney, Agent, or Firm*—Troxell Law Office, PLLC

(57) ABSTRACT

A waterbed having inside air cushion and method of manufacturing same is disclosed. The method comprises forming a watertight bladder having valve means thereon, forming an inflatable air cushion inside the watertight bladder, forming at least one air valve extended from the air cushion through the watertight bladder and secured thereat, inflating the air cushion, filling water into the watertight bladder, and drawing air out of the watertight bladder until the amount of air in a predetermined space of the watertight bladder is substantially reduced to less than 20% by volume, and a water screen is thus formed around the air cushion due to siphonage. The invention can provide an increased degree of softness to the skin of a user, suitably taking away heat from the body of the user, and making muscles supple when the user rolls thereon due to the compressibility of the air cushion.

7 Claims, 4 Drawing Sheets

BLADDER ASSEMBLY AND METHOD OF MANUFACTURING SAME

This is a continuation-in-part of the U.S. patent application Ser. No. 10/870,987 filed on Jun. 21, 2004 now abandoned in the name of Hsuan-Chi Hsieh and entitled "A BLADDER ASSEMBLY AND METHOD OF MANUFACTURING SAME". The subject matter of the above application now has been abandoned.

BACKGROUND OF THE INVENTION

1. Field of the Invention

The present invention relates to bladder assembly and more particularly to such a bladder assembly having inside air cushion and a method of manufacturing same.

2. Description of Related Art

Conventionally, a waterbed or air bed can be used as a bed, mattress, etc. For waterbed, a number of drawbacks have been found. For example, many waterbeds have been constructed with a flat upper surface formed of a single sheet of vinyl. This single sheet tended to conform closely to the body of a user so that it sometimes became difficult for the user's skin to breathe. Perspiration often resulted. Further, since water is a fairly good heat conductor, a heater is typically required to keep water in the bed at a suitably high temperature compatible with the needs of a human body. Furthermore, most waterbeds can be adjusted in firmness by adjusting the amount of water in the bed bladder. But this firmness is the same throughout the bed. Moreover, transportation of a folded waterbed is still not easy due to its bulkiness.

For air bed, despite advantages of being lightweight and easy transportation, the first one of the above drawbacks still exists. Hence, a need for improvement exists.

SUMMARY OF THE INVENTION

It is an object of the present invention to provide a bladder assembly having inside air cushion and a method of manufacturing same. The present invention has the advantages of providing an increased degree of softness to the skin of a person lying thereon, suitably taking away heat from the body of a person, and making muscles supple when the person rolls thereon due to the compressibility of the air cushion.

In an aspect of the present invention there is provided a method of manufacturing a bladder assembly comprising the steps of (i) forming a watertight bladder having valve means thereon; (ii) forming an inflatable air cushion inside the watertight bladder, the air cushion having an outer surface area larger than or equal to an inner surface area of the watertight bladder; (iii) forming at least one air valve extended from the air cushion through the watertight bladder and secured thereat; (iv) inflating the air cushion with air through the air valve until wrinkles are formed around the air cushion, the wrinkles being served as water movement paths; (v) filling water into the watertight bladder through the valve means; and (vi) drawing an amount of air out of the watertight bladder through the valve means until an amount of air in a predetermined space of the watertight bladder is substantially reduced to less than 20% by volume, and a water screen is thus formed around the air cushion and the wrinkles due to siphonage.

In another aspect of the present invention there is provided a still further step of forming a water-absorbing sponge layer between the air cushion and the watertight bladder before the step (iii) wherein both the water screen and the sponge layer are adapted to cooperate each other to suitably take away heat from the body of a person lying on the watertight bladder.

In a further aspect of the present invention there is provided a bladder assembly comprising an external watertight bladder having a valve means thereon, the valve means being adapted to pass both water and air; and an inflatable air cushion enclosed by the watertight bladder, the air cushion including at least one air valve extended through the watertight bladder and secured thereat, whereby filling water into the watertight bladder will draw an amount of air out of the watertight bladder through the valve means until the amount of air in a predetermined space of the watertight bladder is substantially reduced to less than 20% by volume, preferably to 5 to 15%, and a water screen is formed around the air cushion due to siphonage.

In another further aspect of the present invention there is further provided a water-absorbing sponge layer formed on the outer surface of the air cushion.

In yet further aspect of the present invention the air cushion has an outer surface area larger than an inner surface area of the watertight bladder.

In still further aspect of the present invention there is further provided a water-absorbing sponge layer formed between the air cushion and the watertight bladder wherein the air cushion has an outer surface area larger than an inner surface area of the watertight bladder.

In still further aspect of the present invention, the bladder assembly can be used as a bed, mattress, or a holding cushion for human's body portion, such as neck protector, or hip holding ring, etc.

The above and other objects, features and advantages of the present invention will become apparent from the following detailed description taken with the accompanying drawings.

DETAILED DESCRIPTION OF THE PREFERRED EMBODIMENTS

Figure 1:
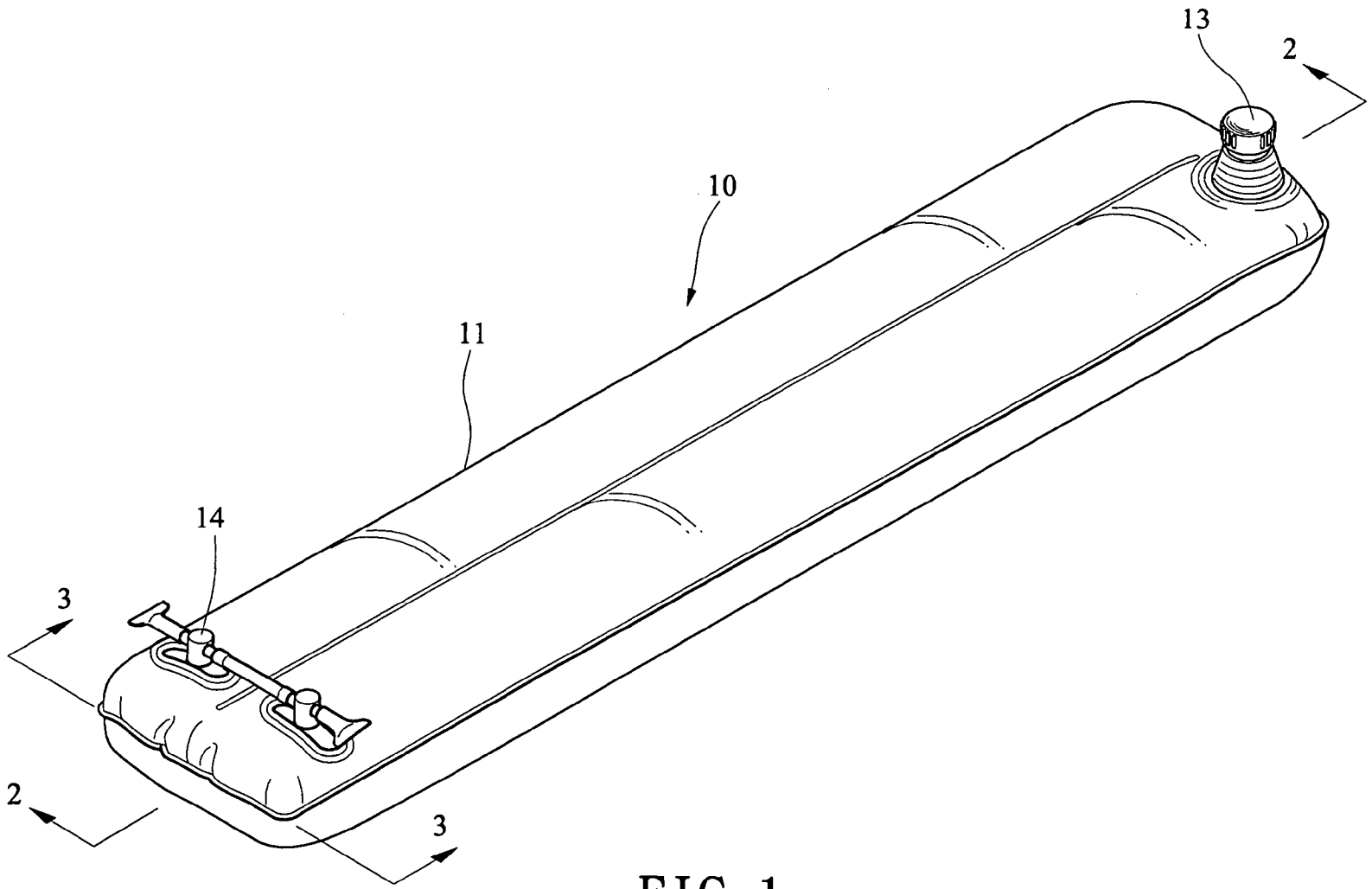
FIG. 1 is a perspective view of a bladder assembly according to a first preferred embodiment of the invention.
Figure 2:
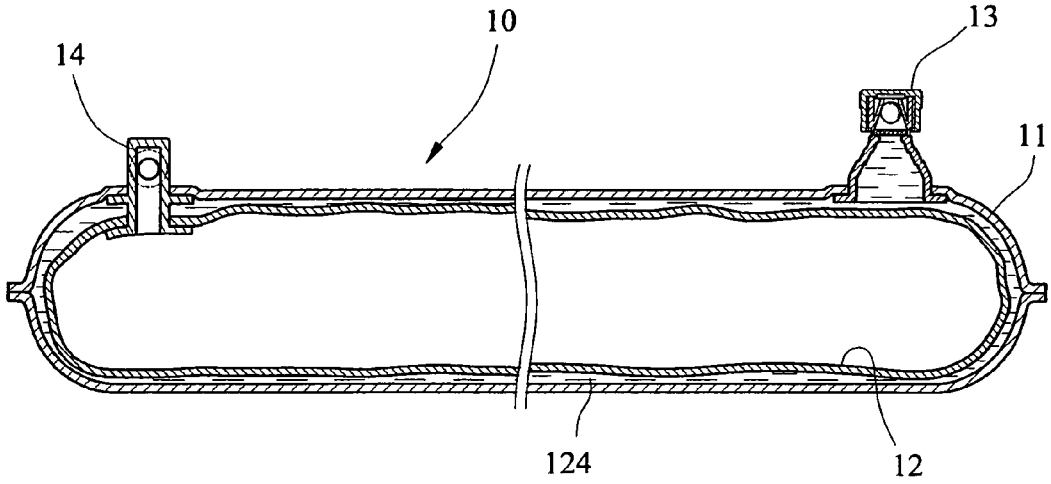
FIG. 2 is a cross-sectional view of the bladder assembly taken along line 2—2 of FIG. 1.
Figure 3:
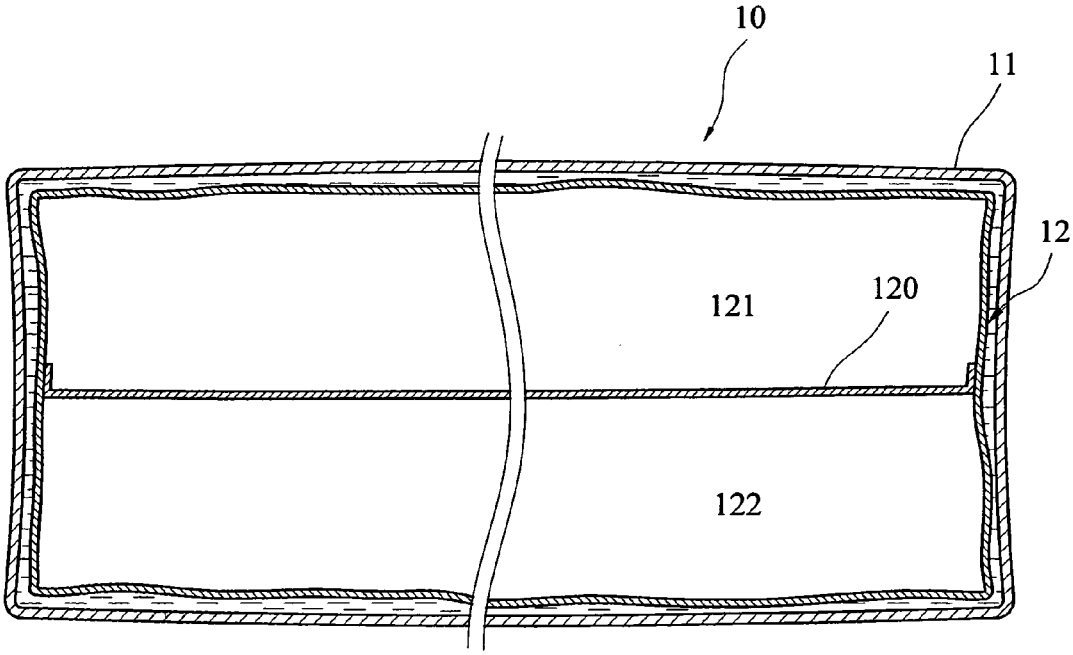
FIG. 3 is a cross-sectional view of the bladder assembly taken along line 3—3 of FIG. 1.

Referring to FIGS. 1 to 3, there is shown a bladder assembly 10 constructed in accordance with a first preferred embodiment of the invention. The bladder assembly 10 can be used as a bed, mattress, or a holding cushion for human's body portion, such as neck protector, or hip holding ring, etc. The bladder assembly 10 comprises an external watertight bladder 11, an inflatable air cushion 12 enclosed by the watertight bladder 11, the air cushion 12 including a divider 120 for dividing the air cushion 12 into two separate air bladders 121, 122, a valve 13 provided on the watertight bladder 11, and two air valves 14 provided on the watertight bladder 11 and communicated with the air bladders 121, 122 respectively.

A method of manufacturing a first embodiment of the bladder assembly 10 is detailed below by referring to FIGS. 2 and 3 specifically. The method comprises the steps of (i) forming a watertight bladder 11 having a valve 13 thereon; (ii) forming an inflatable air cushion 12 having an outer surface area substantially equal to an inner surface area of the watertight bladder 11 so as to receive therein; (iii) forming two air valves 14 extended from the air cushion 12 through the watertight bladder 11 and secured thereat (i.e., the air cushion 12 is secured to the watertight bladder 11); (iv) inflating the air cushion 12 with air through the air valves 14 until a desired firmness is obtained; (v) filling water into the watertight bladder 11 through the valve 13; and (vi) drawing an amount of air out of the watertight bladder 11 through the valve 13 until the amount of air in a predetermined space of the watertight bladder 11 is substantially reduced to less than 20% by volume, preferably to 5% to 15%, and a water screen 124 is thus formed by the watertight bladder 11 around the air cushion 12 due to siphonage. Thus formed bladder assembly 10 has the advantages of providing an increased degree of softness to the skin of a user lying thereon, suitably taking away heat from the body of the user, and making muscles supple when the user rolls thereon due to the compressibility of the air cushion 12 thereunder.

Figure 4:
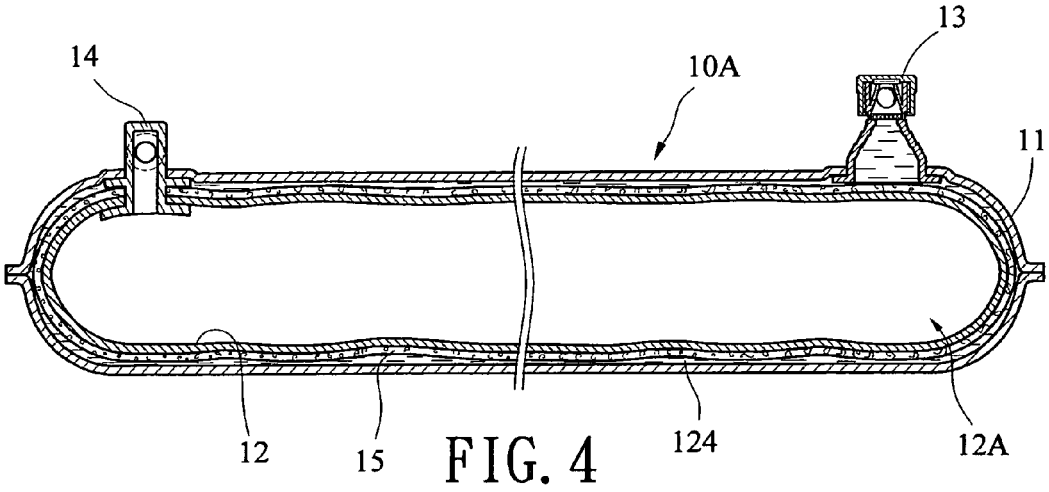
FIG. 4 is a cross-sectional view similar to FIG. 2 for illustrating a second preferred embodiment of the invention.

Referring to FIG. 4, a method of manufacturing a second embodiment of the bladder assembly 10A is detailed below. The method comprises the steps of (i) forming a watertight bladder 11 having a valve 13 thereon; (ii) forming an inflatable air cushion 12A having an outer surface area substantially same as an inner surface area of the watertight bladder 11 so as to receive therein; (iii) forming a water-absorbing sponge layer 15 between the air cushion 12A and the watertight bladder 11; (iv) forming two air valves 14 extended from the air cushion 12A through the sponge layer 15 and the watertight bladder 11 and secured thereat (i.e., the air cushion 12A is secured to the watertight bladder 11); (v) inflating the air cushion 12A with air through the air valves 14 until a desired firmness is obtained; (vi) filling water into the watertight bladder 11 through the valve 13; and (vii) drawing an amount of air out of the watertight bladder 11 through the valve 13 until the amount of air in a predetermined space of the watertight bladder 11 is substantially reduced to less than 20%, preferably to 5% to 15%, and a water screen 124 is thus formed by the watertight bladder 11 around the air cushion 12A and the sponge layer 15 due to siphonage. Thus formed bladder assembly 10A has the advantages of providing an increased degree of softness to the skin of a user lying thereon, suitably taking away heat from the body of the user due to both the water screen 124 and the sponge layer 15, and making muscles supple when the user rolls thereon due to the compressibility of the air cushion 12A thereunder.

Figure 5:
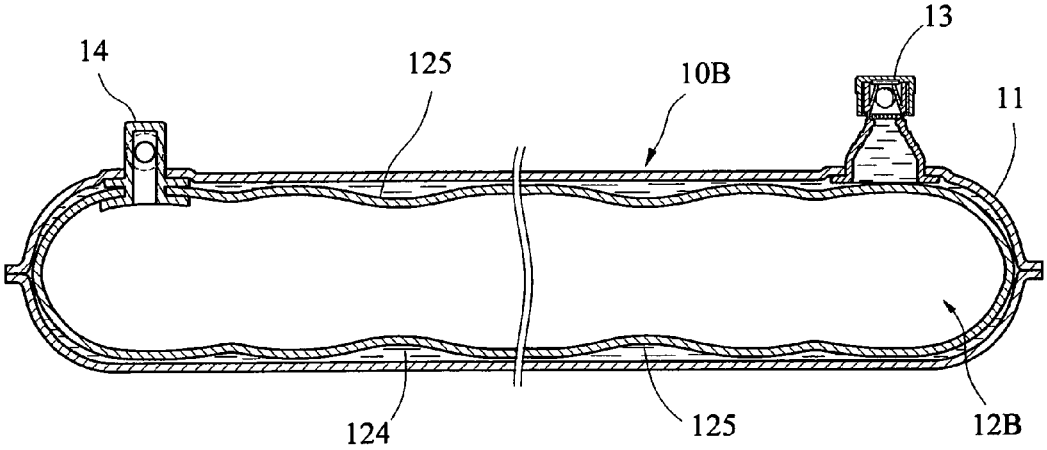
FIG. 5 is a cross-sectional view similar to FIG. 2 for illustrating a third preferred embodiment of the invention.

Referring to FIG. 5, a method of manufacturing a third embodiment of the bladder assembly 10B is detailed below. The method comprises the steps of (i) forming a watertight bladder 11 having a valve 13 thereon; (ii) forming an internal inflatable air cushion 12B having an outer surface area larger than an inner surface area of the watertight bladder 11; (iii) forming two air valves 14 extended from the air cushion 12B through the watertight bladder 11 and secured thereat (i.e., the air cushion 12B is secured to the watertight bladder 11); (iv) inflating the air cushion 12B with air through the air valves 14 until a desired firmness is obtained and wrinkles 125 are formed around the air cushion 12B, since as stated above, the air cushion 12B has an outer surface area larger than an inner surface area of the watertight bladder 11; (v) filling water into the watertight bladder 11 through the valve 13; and (vi) drawing an amount of air out of the watertight bladder 11 through the valve-13 until the amount of air in a predetermined space of the watertight bladder 11 is substantially reduced to no larger than 20% by volume, preferably to 5% to 15%, and a water screen 124 is therefore formed by the watertight bladder 11 around the air cushion 12B due to siphonage and the wrinkles 125 are also formed around the air cushion 12B. Thus formed bladder assembly 10B has the advantages of providing an increased degree of softness to the skin of a user lying thereon, suitably taking away heat from the body of the user due to both the water screen 124 and the wrinkles 125 as water movement paths, and making muscles supple when the user rolls thereon due to the compressibility of the air cushion 12B thereunder.

Figure 6:
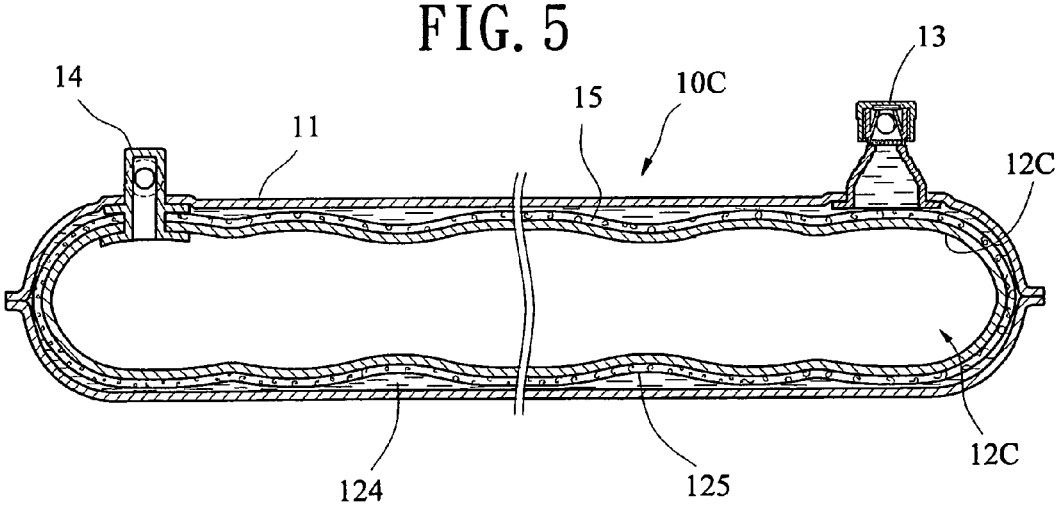
FIG. 6 is a cross-sectional view similar to FIG. 2 for illustrating a fourth preferred embodiment of the invention.

Referring to FIG. 6, a method of manufacturing a fourth embodiment of the bladder assembly 10C is detailed below. The method comprises the steps of (i) forming a watertight bladder 11 having a valve 13 thereon; (ii) forming an internal inflatable air cushion 12C having an outer surface area larger than an inner surface area of the watertight bladder 11; (iii) forming a water-absorbing sponge layer 15 at least on a portion of the air cushion 12C; (iv) forming two air valves 14 extended from the air cushion 12C through the sponge layer 15, the watertight bladder 11 and secured thereat (i.e., the air cushion 12C is secured to the watertight bladder 11); (v) inflating the air cushion 12C with air through the air valves 14 until a desired firmness is obtained and wrinkles 125 are formed around the air cushion 12C since as stated above, the air cushion 12C has an outer surface area larger than an inner surface area of the watertight bladder 11; (vi) filling water into the watertight bladder 11 through the valve 13; and (vi) drawing an amount of air out of the watertight bladder 11 through the valve 13 until the amount of air in a predetermined space of the watertight bladder 11 is substantially reduced to no larger than 20% by volume, preferably to 5% to 15%, and a water screen 124 is therefore formed by the watertight bladder 11 around the air cushion 12C, the sponge layer 15 and the wrinkles 125 due to siphonage. Thus formed bladder assembly 10C has the advantages of providing an increased degree of softness to the skin of a user lying thereon, suitably taking away heat from the body of the user due to the water screen 124, the wrinkles 125 (as water movement paths), and the sponge layer 15, and making muscles supple when the user rolls thereon due to the compressibility of the air cushion 12C thereunder.

Figure 7:
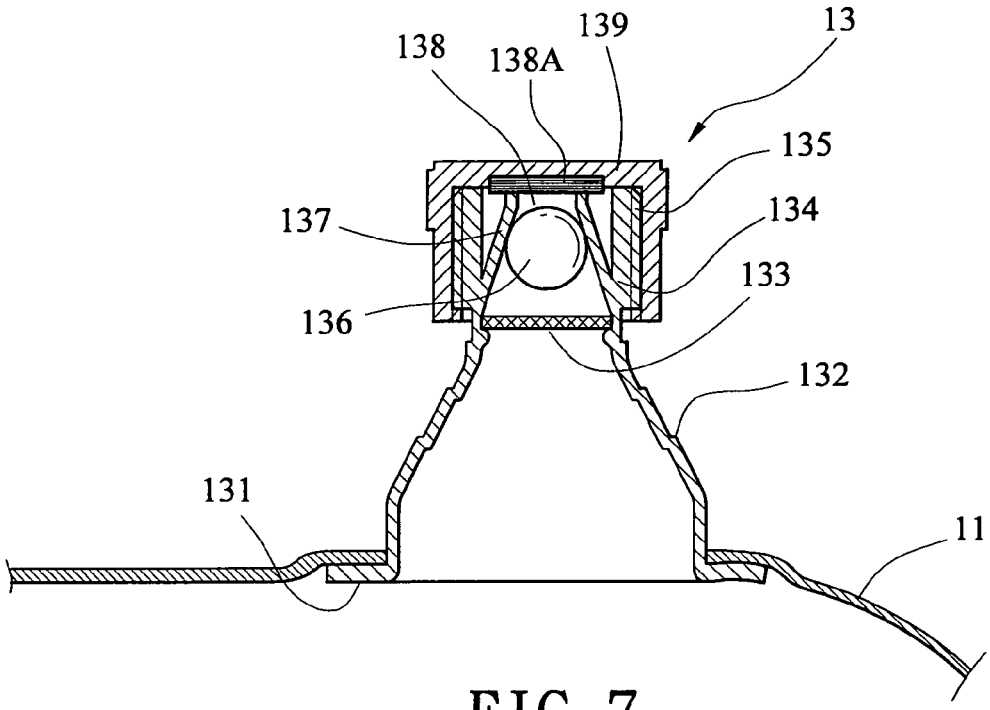
FIG. 7 is a cross-sectional view of the valve in a use position.
Figure 8:
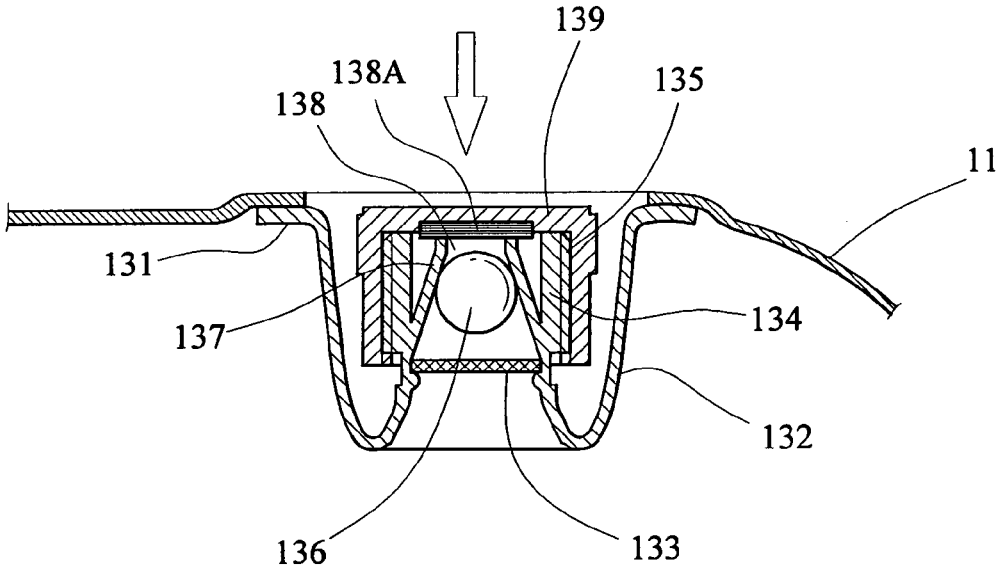
FIG. 8 is a cross-sectional view of the valve in a storage position.

Referring to FIGS. 7 and 8, the construction of the valve 13 will now be described in detail below. As stated above, the valve 13 has the functions of permitting both water and air to flow through. As seen from the use position (see FIG. 7), the valve 13 comprises a bellows base 132 having legs 131 formed on an orifice of the watertight bladder 11, a chamber 138 extended upwardly from the bellows base 132, a sealing member 138A put on the top of the chamber 138, a mesh board 133 between the bellows base 132 and the chamber 138 for permitting both air and water to pass, the chamber 138 having an upper conic section 137, a ball 136 stopped by the conic section 137, and an outer cylinder 134 extended upwardly from the base of the conic section 137, the cylinder 134 having upper outer threads 135, and a cap 139 threadedly secured to the threads 135 for closing the valve 13. In use, open the cap 139 prior to filling water to push the ball 136 down to the mesh board 133. As a result, water is poured into the watertight bladder 11 through the mesh board 133. For drawing air out of the watertight bladder 11, simply compress the watertight bladder 11 to exit air via the ball 136 but water passage is blocked at the chamber 138. As a result, an amount of air in a predetermined space of the watertight bladder 11 substantially reduced to no larger than 20% by volume, preferably to 5% to 15%, is achieved in the watertight bladder 11. It is to be noted that the purpose of drawing air out of the watertight bladder 11 as mentioned above controlled to less than 20% by volume is contemplated to surely obtain a water screen 124 formed by the watertight bladder 11 around the air cushion 12C the sponge layer 15 and the wrinkles 125 due to siphonage. In accordance with the present invention, it has been found by experiments that the siphonage action is performed inside the watertight bladder 11 by carefully controlling an amount of air in a predetermined space of the watertight bladder 11 substantially reduced to no larger than 20% by volume, preferably to 5% to 15%. Moreover, a user may press the valve 13 down into the watertight bladder 11 for storage of the bladder assembly (see FIG. 8).

As mentioned above, the bladder assembly of the present invention has a fairly good firmness for human's body, so that it is suitably used as a bed, mattress, or a holding cushion for human's body.

While the invention herein disclosed has been described by means of specific embodiments, numerous modifications and variations could be made thereto by those skilled in the art without departing from the scope and spirit of the invention set forth in the claims.

What is claimed is:

1. A method of manufacturing a bladder assembly comprising the steps of:

(i) forming a watertight bladder having a valve device thereon;

(ii) forming an inflatable air cushion inside the watertight bladder, the air cushion having an outer surface area substantially the same as an inner surface area of the watertight bladder;

(iii) forming at least one air valve extended from the air cushion through the watertight bladder and secured thereto;

(iv) inflating the air cushion with air through at least one air valve;

(v) filling water into the watertight bladder through the valve device; and (vi) drawing an amount of air out of the watertight bladder through the valve device until the amount of air in a predetermined space of the watertight bladder is substantially reduced to no larger than 20% by volume and a water screen is thus formed around the air cushion due to siphonage.

2. The method of claim 1, further comprising the step of forming a water-absorbing sponge layer attached on at least a portion of an outer surface of the air cushion before the step (iii) wherein both the water screen and the sponge layer are adapted to cooperate each other to suitably take away heat from the body of a person lying on the watertight bladder.

3. The method of claim 1, wherein the step of (vi) drawing the amount of air out of the watertight bladder is preferably reduced to 5% to 15% by volume.

4. A bladder assembly comprising:

an external watertight bladder having a valve device thereon, the valve device being adapted to pass both water and air; and an inflatable air cushion enclosed by the watertight bladder, the air cushion having an outer surface area substantially the same as an inner surface area of the watertight bladder, the air cushion including at least one air valve extended through the watertight bladder and secured thereto, whereby inflating the air cushion and filling water into the watertight bladder will draw an amount of air out of the watertight bladder through the valve device until the amount of air in a predetermined space of the watertight bladder is substantially reduced to no larger than 20% by volume and a water screen is thus formed around the air cushion due to siphonage.

5. The bladder assembly of claim 4, further comprising a water-absorbing sponge layer formed between the air cushion and the watertight bladder.

6. The bladder assembly of claim 5, wherein the water-absorbing sponge layer is attached on at least one portion of an outer surface of the air cushion.

7. The bladder assembly of claim 4, wherein the bladder assembly is used as a bed, a mattress and a holding cushion for a human's body.

* * * * *